US007635550B2

(12) United States Patent
Teshima

(10) Patent No.: US 7,635,550 B2
(45) Date of Patent: Dec. 22, 2009

(54) METHOD OF PRODUCING LIQUID DEVELOPER AND LIQUID DEVELOPER PRODUCED BY THE METHOD

(75) Inventor: Takashi Teshima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 441 days.

(21) Appl. No.: 11/372,236

(22) Filed: Mar. 9, 2006

(65) Prior Publication Data

US 2006/0204884 A1 Sep. 14, 2006

(30) Foreign Application Priority Data

Mar. 9, 2005 (JP) ..... 2005-066376

(51) Int. Cl.
*G03G 9/125* (2006.01)

(52) U.S. Cl. ..... 430/137.22

(58) Field of Classification Search ..... 430/112, 430/137.22

See application file for complete search history.

(56) References Cited

U.S. PATENT DOCUMENTS 3,857,549 A * 12/1974 Snelling ..... 399/131
5,308,734 A * 5/1994 Sacripante et al. ..... 430/137.14
5,780,196 A * 7/1998 Fujiwara et al. ..... 430/137.19

FOREIGN PATENT DOCUMENTS

JP 07-234551 9/1995
JP 2000-19787 A * 1/2000

OTHER PUBLICATIONS

English translation of abstract of JP 2000-19787 A, published Jan. 2000.*

* cited by examiner

*Primary Examiner*—Mark F Huff
*Assistant Examiner*—Peter L Vajda
(74) *Attorney, Agent, or Firm*—Hogan & Hartson LLP

(57) ABSTRACT

A method of producing a liquid developer which comprises an insulation liquid and toner particles dispersed in the solution is provided. The method comprises the steps of: preparing a kneaded material containing a coloring agent and a resin material; dispersing the kneaded material into an insulation liquid to obtain a molten state kneaded material dispersed liquid in which the kneaded material in a molten state is finely dispersed; and cooling the molten state kneaded material dispersed liquid to solidify the molten state kneaded material; wherein the insulation liquid contains as its major component an unsaturated fatty acid. According to the method, it is possible to provide a liquid developer in which toner particles having a small particle size distribution and a uniform shape are dispersed so that properties of each component of the toner particles can be exhibited sufficiently. The liquid developer mentioned above is also harmless to environment.

11 Claims, 4 Drawing Sheets

METHOD OF PRODUCING LIQUID DEVELOPER AND LIQUID DEVELOPER PRODUCED BY THE METHOD

BACKGROUND OF THE INVENTION

1. Field of the Invention

The present invention relates to a method of producing a liquid developer and a liquid developer produced by the method.

2. Description of the Prior Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof. The other type of such a developer is known as a liquid developer which is obtained by dispersing toner particles into a carrier liquid having electric insulation properties.

In the developing method using such a dry toner, since a solid state toner is used, there is an advantage in handleability thereof. On the other hand, however, this method involves problems in that contamination is likely to be caused by dispersal of toner powder and toner particles are likely to be massed together in a cartridge. Further, in such a dry toner, since aggregation of toner particles is likely to occur in the producing process thereof, it is difficult to obtain toner particles each having a sufficiently small diameter. This means that it is difficult to form a toner image having high resolution. Furthermore, there is also a problem in that when the size of the toner particle is made to be relatively small, the problems resulted from the powder form of the dry toner described above becomes more serious.

On the other hand, in the developing method using the liquid developer, since aggregation of toner particles in the liquid developer is effectively prevented, it is possible to use very fine toner particles and it is also possible to use a binder resin having a low softening point (a low softening temperature). As a result, the method using the liquid developer has the features such as good reproductivity of an image composed of thin lines, good tone reproductivity as well as good reproductivity of colors. Further, the method using the liquid developer is also superior as a method for forming an image at high speed.

Conventionally, such a liquid developer is produced by a grinding method in which toner particles are produced by grinding a resin (see JP-A No. 07-234551, for example) or a polymerization method in which monomer components are polymerized in a solution having electric insulation to produce resin particles which are not soluble in the electric insulation solution (see JP-B No. 08-7470, for example).

However, these conventional liquid developer producing methods accompany such problems as described below.

In the grinding method, it is difficult to grind toner particles to a sufficiently small size (e.g. 5 μm or less) by which the above described effects resulted from the use of the liquid developer can be exhibited sufficiently. Namely, it takes very long time or it requires very large energy in order to obtain toner particles having such a sufficiently small size, thus leading to extremely low productivity of a liquid developer. Further, in the grinding method, a particle size distribution of toner particles is likely to be large (that is, there are large variations in particle size), and the shapes of the toner particles are liable to be irregular and nonuniform. As a result, obtained toner particles are likely to have variations in their properties among the toner particles.

Further, in the polymerization method, it is difficult to set polymerization conditions properly. This means that it is difficult to form toner particles having a desired size. Further, it is also difficult to make the variations in the size of the toner particles sufficiently small. As a result, stability of quality of a liquid developer and reliability thereof are likely to be low. Further, since the polymerization method requires a relatively long time for the formation of the toner particles, the productivity of the liquid developer is not so high.

Furthermore, since the carrier liquid having electric insulation properties (namely, the insulation liquid) used in the above described method has low compatibility to components of the toner particles, aggregation between the toner particles is likely to occur, whereby making it difficult to keep a good dispersion state of the toner particles in the carrier liquid for a long period of time. Therefore, it is difficult to preserve the liquid developer for a long period of time.

SUMMARY OF THE PRESENT INVENTION

Accordingly, it is an object of the present invention to provide a liquid developer in which toner particles having a small particle size distribution and a uniform shape are dispersed so that properties of each component of the toner particles can be exhibited sufficiently, and in particular, to provide such a liquid developer which is also harmless to environment.

Further, it is another object of the present invention to provide a liquid developer producing method which can produce such a liquid developer effectively.

In order to achieve the above mentioned objects, one aspect of the present invention is directed to a method of producing a liquid developer which comprises an insulation liquid and toner particles dispersed in the insulation liquid. The method comprises the steps of: preparing a kneaded material containing a coloring agent and a resin material; dispersing the kneaded material into an insulation liquid to obtain a molten state kneaded material dispersed liquid in which the kneaded material in a molten state is finely dispersed; and cooling the molten state kneaded material dispersed liquid to solidify the molten state kneaded material; wherein the insulation liquid contains as its major component an unsaturated fatty acid.

According to this method, it is possible to provide a liquid developer in which toner particles having a small particle size distribution and a uniform shape are dispersed and properties of each component of the toner particles can be exhibited sufficiently. In particular, a liquid developer harmless to environment can be provided by the method.

In the liquid developer producing method according to the present invention, it is preferred that in the kneaded material dispersing step the molten state kneaded material dispersed liquid is prepared by adding a ground kneaded material obtained by grinding the kneaded material in a solid state to the insulation liquid and then heating the liquid containing the ground kneaded material at a predetermined temperature to transform the solid state kneaded material into the molten state kneaded material.

This ensures that the molten state kneaded material dispersed liquid in which the molten state kneaded material is finely and homogeneously dispersed in the insulation liquid can be prepared effectively. Further, the molten state kneaded material (dispersoid) in the molten state kneaded material dispersed liquid can be made to have a relatively uniform particle diameter. Furthermore, according to this method, thermal hysteresis in the molten state kneaded material dispersed liquid preparing step can be made small, thus leading to an advantage in saving energy consumption.

In the liquid developer producing method according to the present invention, it is preferred that when the predetermined heating temperature of the ground kneaded material is defined as Th (° C.), a softening point of the resin material is defined as $T_f$(° C.), and a boiling point of the insulation liquid is defined as Tb (° C.), a relation of $T_f \leqq Th \leqq Tb$ is satisfied.

By satisfying such a relationship, it becomes possible to obtain the molten state kneaded material dispersed liquid in which the molten state kneaded material (dipsersoid) having more uniform shape is dispersed while preventing deterioration of the insulation liquid.

In the liquid developer producing method according to the present invention, it is preferred that the cooling rate of the molten state kneaded material dispersed liquid in the cooling step is 100° C./sec or lower.

This makes it possible to produce a liquid developer in which toner particles having uniform shape and size are dispersed while preventing aggregation of the molten state kneaded materials (dispersoids) which are finely dispersed in the molten state kneaded material dispersed liquid.

In the liquid developer producing method according to the present invention, it is preferred that the molten state kneaded material dispersed liquid is prepared in a non-oxygenated atmosphere.

According to this, it is possible to prevent the insulation liquid from being deteriorated due to oxidization during heating.

Another aspect of the present invention is directed to a liquid developer produced using the liquid developer producing method according to the present invention.

By producing a liquid developer by the method of the present invention, it is possible to provide a liquid developer in which toner particles having a small particle size distribution and a uniform shape are dispersed and properties of each component of the toner particles can be exhibited sufficiently. In particular, a liquid developer harmless to environment can be provided.

In the liquid developer according to the present invention, it is preferred that an average particle size of the toner particles of the liquid developer is in the range of 0.1 to 5 μm.

This makes it possible to make variations in properties of the toner particles such as chargeable characteristics and fixing properties small, and therefore the reliability of the liquid developer as a whole can be made especially high, and the resolution of an image to be formed using the liquid developer (liquid toner) can be also made especially high.

Further, in the liquid developer according to the present invention, it is preferred that the standard deviation in the particle size among the toner particles is 3.0 μm or less.

This makes it possible to make variations in properties such as chargeable characteristics and fixing properties particularly small, thereby enabling to improve reliability of the liquid developer as a whole.

Furthermore, in the liquid developer according to the present invention, it is preferred that an average value of the roundness R (average sphericity) of the toner particles represented by the following formula (I) is 0.85 or more:

$$R = L_0/L_1 \quad \text{(I)}$$

whrein $L_1$ (μm) represents the circumference of a projected image of a toner particle, and $L_0$ (μm) represents the circumference of a perfect circle (a geometrically perfect circle) having the same area as that of the projected image of the toner particle.

This makes it possible to make the size of each toner particle sufficiently small, and therefore the toner particles can have excellent transfer efficiency and mechanical strength.

Moreover, in the liquid developer according to the present invention, it is preferred that the standard deviation in the average roundness among the toner particles is 0.15 or less.

This also makes it possible to make variations in properties such as chargeable characteristics and fixing properties particularly small, thereby enabling to improve reliability of the liquid developer as a whole.

These and other objects, structures and effects of the present invention will be more apparent when the following detailed description of the preferred embodiments and the examples will be considered taken in conjunction with the appended drawings.

DETAILED DESCRIPTION OF THE PREFERRED EMBODIMENTS

Hereinbelow, with reference to the accompanying drawings, a preferred embodiment of a method of producing a liquid developer according to the present invention and a liquid developer manufactured by the method will be described in details.

Figure 1:
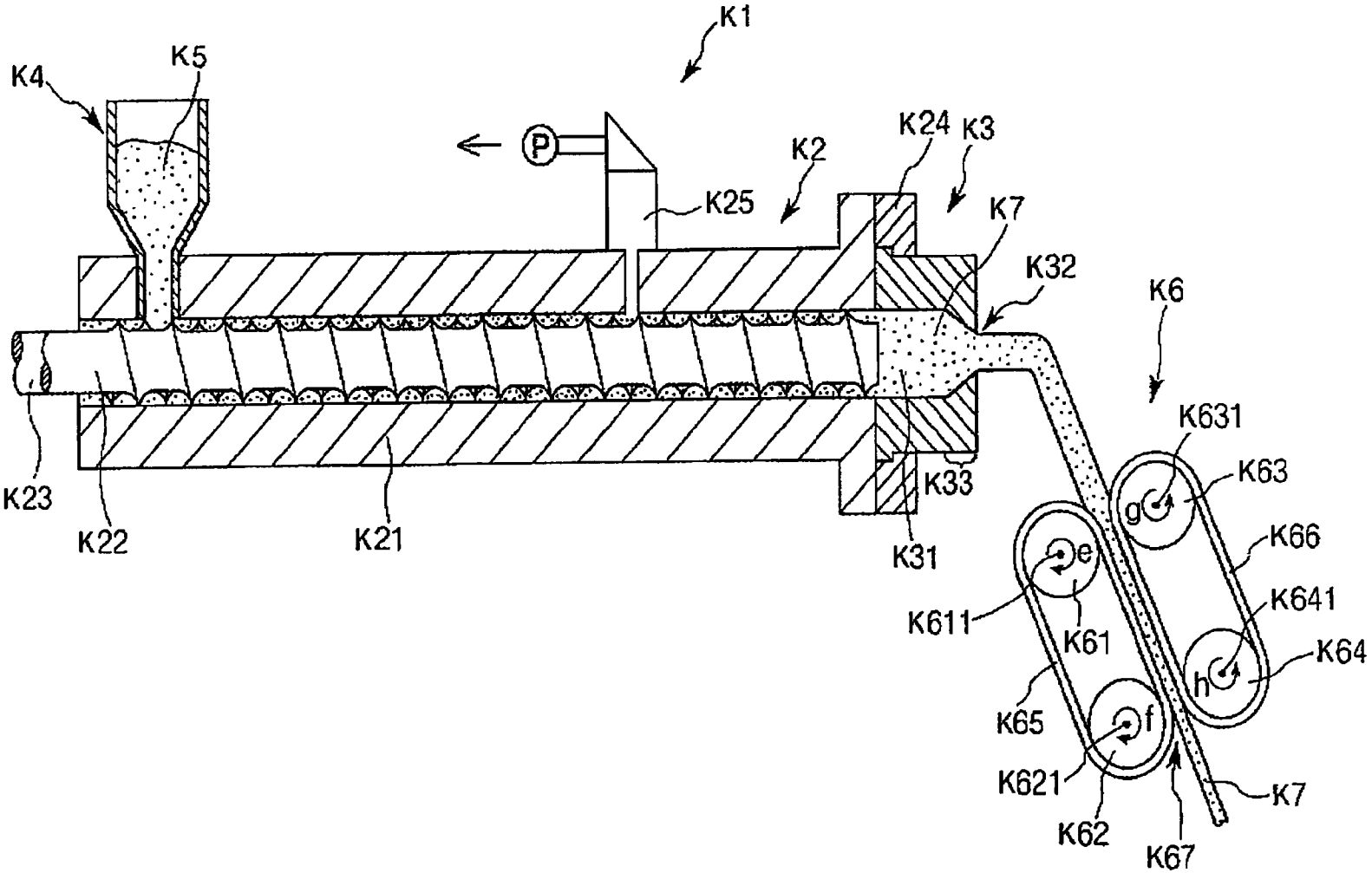
FIG. 1 is a vertical cross-sectional view which schematically shows one example of the structure of a kneading machine and a cooling machine for producing a kneaded material used for preparing a molten state kneaded material dispersed liquid.

FIG. 1 is a vertical cross-sectional view which schematically shows one example of the structure of a kneading machine and a cooling machine for producing a kneaded material used for preparing a molten state kneaded material dispersed liquid. In the following description, the left side in FIG. 1 denotes "base" or "base side" and the right side in FIG. 1 denotes "front" or "front side".

The liquid developer producing method according to the present invention is characterized by comprising:

preparing a kneaded material containing a coloring agent and a resin material;

dispersing the kneaded material into an insulation liquid to obtain a molten state kneaded material dispersed liquid in which the kneaded material in a molten state is finely dispersed; and cooling the molten state kneaded material dispersed liquid to solidify the molten state kneaded material;

wherein the insulation liquid contains as its major component an unsaturated fatty acid.

<Constituent Material of Kneaded Material>

A kneaded material can be obtained through a kneading step described below. The kneaded material contains components for forming toner particles of a liquid developer, in which the components include at least a binder resin (resin material) and a coloring agent.

First, a description will be made with regard to a constituent material used for preparing the kneaded material.

1. Resin (Binder Resin)

Toner particles contained in a liquid developer are constituted from a material which contains a resin (binder resin) as its main component.

In the present invention, there is no specific limitation on the kinds of resin (binder resin) to be used. Examples of such resins (binder resins) include (meth)acrylic-based resins, polycarbonate resins, styrene-based resins (homopolymers or copolymers containing styrene or a styrene substituent) such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic ester copolymer, styrene-acrylic ester-methacrylic ester copolymer, styrene-α-methyl chloroacrylate copolymer, styrene-acrylonitrile-acrylic ester copolymer, and styrene-vinyl methyl ether copolymer, polyester-based resins, epoxy resins, urethane-modified epoxy resins, silicone-modified epoxy resins, vinyl chloride resins, rosin-modified maleic acid resins, phenyl resins, polyethylene-based resins, polypropylene, ionomer resins, polyurethane resins, silicone resins, ketone resins, ethylene-ethylacrylate copolymer, xylene reins, polyvinyl butyral resins, terpene reins, phenol resins, and aliphatic or alicyclic hydrocarbon resins. These binder resins can be used singly or in combination of two or more of them.

Among these resins listed above, polyester resins, epoxy resins, styrene-acrylic ester copolymer and acrylic resins are preferably used since these resins have excellent dispersibility (compatibility) to an insulation liquid which contains as its main component an unsaturated fatty acid (which will be described later in detail).

The softening point of the resin (resin material) is not particularly limited to any specific value, but it is preferably in the range of 50 to 130° C., more preferably in the range of 50 to 120° C., and even more preferably in the range of 65 to 115° C. In this specification, the term "softening point" means a temperature at which softening is begun under the conditions that a temperature raising speed is 5° C./mim and a diameter of a die hole is 1.0 mm in a high-floored flow tester.

2. Coloring Agent

The toner particles of the liquid developer also include a coloring agent. As for a coloring agent, pigments, dyes or the like can be used. Examples of such pigments and dyes include Carbon Black, Spirit Black, Lamp Black (C.I. No. 77266), Magnetite, Titanium Black, Chrome Yellow, Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Eosine Lake. Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chalco Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2. C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

3. Other Components

In preparing the kneaded material, additional components other than the above components may be contained. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Further, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the constituent material of the kneaded material may further contain zinc stearate, zinc oxide, cerium oxide, silica, titanium oxide, iron oxide, aliphatic acid, or aliphatic metal salt, or the like in addition to the components described above.

Furthermore, the constituent material of the kneaded material may further contain a component used as solvent such as inorganic solvent, organic solvent and the like. This makes it possible to improve kneading efficiency so that the kneaded material in which each component thereof is mixed with each other more homogeneously can be obtained.

<Kneaded Material>

Hereinbelow, a description will be made with regard to one example of a method for obtaining a kneaded material K7 by kneading a material K5 which contains the above-mentioned components.

The kneaded material K7 can be manufactured using a kneading machine as shown in FIG. 1.

<Kneading Step>

The material K5 to be kneaded contains the components as described above. Since the material K5 contains a coloring agent, air contained in the coloring agent is likely to be included in the material K5. This means that there is a possibility that air bubble may enter the inside of the toner particle. However, since the material K5 is subjected to the kneading process in this step, it is possible to eliminate air contained in the material K5 efficiently, and therefore it is possible to prevent air bubble from entering the inside of the toner particle effectively, that is, prevent air bubble from remaining inside the toner particle effectively. Further, it is preferred that the material K5 to be kneaded is prepared in advance by mixing the above-mentioned various components.

In this embodiment, a biaxial kneader-extruder is used as the kneading machine, a detail of which will be described below.

The kneading machine K1 includes a process section K2 which kneads the material K5 while conveying it, a head section K3 which extrudes a kneaded material K7 so that an extruded kneaded material can have a prescribed cross-sectional shape, and a feeder K4 which supplies the material K5 into the process section K2.

The process section K2 has a barrel K21, screws K22 and K23 inserted into the barrel 21, and a fixing member K24 for fixing the head section K3 to the front portion of the barrel K21.

In the process section K2, a shearing force is applied to the material K5 supplied from the feeder K4 by the rotation of the screws K22 and K23 so that a homogeneous kneaded material K7 is obtained.

In this embodiment, it is preferred that the total length of the process section K2 is in the range of 50 to 300 cm, and more preferably in the range of 100 to 250 cm. If the total length of the process section K2 is less than the above lower limit value, there is a case that it is difficult to mix and knead the components in the material K5 homogeneously. On the other hand, if the total length of the process section K2 exceeds the above upper limit value, there is a case that thermal modification of the material K5 is likely to occur depending on the temperature inside the process section K2, the number of revolutions of the screws K22 and K23, or the like, thus leading to a possibility that it becomes difficult to control the physical properties of a finally obtained liquid developer (that is, resultant liquid toner) sufficiently.

In this connection, the temperature of the material (material temperature) during the kneading step is preferably in the range of 80 to 260° C., and more preferably in the range of 90 to 230° C. though it varies depending on the composition of the material K5 and the like. In this regard, it is to be noted that the temperature of the material inside the process section K2 may be constant throughout the process section K2 or different depending on positions inside the process section K2. For example, the process section K2 may include a first region in which an internal temperature is set to be relatively low and a second region which is provided at the base side of the first region and in which an internal temperature is set to be higher than the internal temperature of the first region.

Moreover, it is preferred that the residence time of the material K5 in the process section K2, that is the time required for the material K5 to pass through the process section K2, is 0.5 to 12 minutes, and more preferably 1 to 7 minutes. If the residence time of the material K5 in the process section K2 is less than the above lower limit value, there is a possibility that it is difficult to mix the components in the material K5 homogeneously. On the other hand, if the residence time of the material K5 in the process section K2 exceeds the above upper limit value, there is a possibility that production efficiency is lowered, and thermal modification of the material K5 is likely to occur depending on the temperature inside the process section 2 or the number of revolutions of the screws K22 and K23 or the like, thus resulting in a case that it is difficult to control the physical properties of a finally obtained liquid developer (that is, a resultant liquid toner) satisfactorily.

Although the number of revolutions of the screws K22 and K23 varies depending on the compositions of the binder resin or the like, it is preferably in the range of 50 to 600 rpm. If the number of revolutions of the screws K22 and K23 is less than the above lower limit value, there is a case that it is difficult to mix the components of the material K5 homogeneously. On the other hand, if the number of revolutions of the screws K22 and K23 exceeds the above upper limit value, there is a case that molecular chains of the resin are cut due to a shearing force, thus resulting in the deterioration of the characteristics of the resin.

In the kneading machine K1 used in this embodiment, the inside of the process section K2 is connected to a pump P through a duct K25. This makes it possible to deaerate the inside of the process section K2, thereby enabling to prevent the pressure inside the process section K2 from raising due to heated-up or heat generation of the material K5 (kneaded material K7). As a result, the kneading step can be carried out safely and effectively. Further, since it is possible to prevent air bubble (in particular, relatively large air bubble) from being contained in the kneaded material K7 effectively, a liquid developer (that is, a liquid toner) having excellent properties can be obtained.

<Extrusion Process>

The kneaded material K7 which has been kneaded in the process section K2 is extruded to the outside of the kneading machine K1 via the head section K3 by the rotation of the screws K22 and K23.

The head section K3 has an internal space K31 to which the kneaded material K7 is sent from the process section K2, and an extrusion port K32 through which the kneaded material K7 is extruded.

In this connection, it is preferred that the temperature (temperature at least in the vicinity of the extrusion port K32) of the kneaded material K7 in the internal space K31 is higher than the softening point of the resin materials contained in the material K5. When the temperature of the kneaded material K7 is such a temperature, it is possible to obtain toner particles in which the components thereof are homogeneously mixed, thereby enabling to make variations in their properties such as chargeable characteristics, fixing properties, and the like especially small.

The concrete temperature of the kneaded material K7 inside the internal space K31 (that is, the temperature of the kneaded material K7 at least in the vicinity of the extrusion port K32) is not limited to a specific temperature, but is preferably in the range of 80 to 150° C., and more preferably in the range of 90 to 140° C. In the case where the temperature of the kneaded material K7 in the internal space K31 is within the above range, the kneaded material K7 is not solidified inside the internal space K31 so that it can be extruded from the extrusion port 32K easily.

The internal space K31 having a structure as shown in FIG. 1 includes a cross sectional area reduced portion K33 in which a cross sectional area thereof is gradually reduced toward the extrusion port K32. Due to the cross sectional area reduced portion K33, the extrusion amount of the kneaded material K7 which is to be extruded from the extrusion port 32K becomes stable, and the cooling rate of the kneaded material K7 in a cooling process which will be described later also becomes stable. As a result of this, variations in properties of the obtained toner particles can be made small, whereby enabling to produce a liquid developer (that is, a liquid toner) having excellent properties.

<Cooling Process>

The kneaded material K7 in a softened state extruded from the extrusion port K32 of the head section 3 is cooled by a cooler K6 and thereby it is solidified.

The cooler K6 has rolls K61, K62, K63 and K64, and belts K65 and K66.

The belt K65 is wound around the rolls K61 and K62, and similarly, the belt 66 is wound around the rolls K63 and K64.

The rolls K61, K62, K63 and K64 rotate in directions shown by the arrows e, f, g and h in the drawing about rotary shafts K611, K621, K631 and K641, respectively. With this arrangement, the kneaded material K7 extruded from the extrusion port K32 of the kneading machine K1 is introduced into the space between the belts K65 and K66. The kneaded material K7 is then cooled while being molded into a plate-like object with a nearly uniform thickness, and is ejected from an ejection part K67. The belts K65 and K66 are cooled by, for example, an air cooling or water cooling method. By using such a belt type cooler, it is possible to extend a contact time between the kneaded, material extruded from the kneading machine and the cooling members (belts), thereby enabling the cooling efficiency for the kneaded material to be especially excellent.

Now, during the kneading process, since the material K5 is subjected to a shearing force, phase separation (in particular, macro-phase separation) can be prevented. However, since the kneaded material K7 which has been discharged out of the kneading process is free from the shearing force, there is a possibility that phase separation (in particular, macro-phase separation) will occur again if such a kneaded material is being left for a long period of time. Accordingly, it is preferable to cool the thus obtained kneaded material K7 as quickly as possible. More specifically, it is preferred that the cooling rate (for example, the cooling rate when the kneaded material K7 is cooled down to about 60° C.) of the kneaded material K7 is faster than −3° C./s, and more preferably in the range of −5 to −100° C./s. Moreover, the time between the completion of the kneading process (at which the kneaded material is free from the shearing force) and the completion of the cooling process (time required to lower the temperature of the kneaded material K7 to 60° C. or lower, for example) is preferably 20 seconds or less, and more preferably in the range of 3 to 12 seconds.

In the above embodiment, a description has been made in terms of an example using a continuous biaxial kneader-extruder as the kneading machine, but the kneading machine used for kneading the material is not limited to this type. For kneading the material, it is possible to use various kinds of kneading machines, for example, a kneader, a batch type triaxial roll, a continuous biaxial roll, a wheel mixer, a blade mixer, or the like.

Further, although in the embodiment shown in the drawing the kneading machine is of the type that has two screws, the number of screws may be one or three or more. Further, the kneading machine may have a disc section (kneading disc section).

Furthermore, in the embodiment described above, one kneading machine is used for kneading the material, but kneading may be carried out by using two kneading machines. In this case, the heating temperature of the material and the rotational speed of the screws of one kneading machine may be different from those of the other kneading machine.

Moreover, in the above embodiment, the belt type cooler is used, but a roll type (cooling roll type) cooler may be used. Furthermore, cooling of the kneaded material extruded from the extrusion port K32 of the kneading machine is not limited to the way using the cooler described above, and it may be carried out by air cooling, for example.

<Grinding Process>

The kneaded material K7 obtained through the cooling process described above was ground. By using such a ground kneaded material K7, it is possible to obtain relatively easily a molten state kneaded material dispersed liquid (described later) in which a fine dispersoid (that is, a molten state kneaded material) is dispersed. As a result, it becomes possible to make the size of the toner particles smaller in a liquid developer finally obtained, and such a liquid developer can be preferably used in forming a high resolution image.

The method of grinding is not particularly limited. For example, such grinding may be carried out by employing various kinds of grinding machines or crushing machines such as a ball mill, a vibration mill, a jet mill, a pin mill, or the like.

The grinding process may be carried out by dividing it into a plurality of stages (for example, two stages of coarse and fine grinding processes). Further, after the grinding process, other treatment such as classification treatment may be carried out as needed. Such classification treatment may be carried out using a sieve or an air flow type classifier or the like.

By subjecting the material K5 to the kneading process as described above, it is possible to eliminate air contained in the material K5 effectively. In other words, the kneaded material K7 obtained through such a kneading process does not contain air (air bubble) in the inside thereof. By using such a kneaded material K7, it is possible to prevent formation of toner particles having irregular shapes (such as void particles, defect particles, molten particles, and the like) effectively. As a result, in a liquid developer finally obtained, it is possible to prevent occurrence of a problem such as lowered transfer property and cleaning property which are caused by such toner particles having irregular shapes.

In the present invention, a molten state kneaded material dispersed liquid is prepared using the kneaded material described above.

By using the kneaded material K7 described above in preparing the molten state kneaded material dispersed liquid, the following effects can be obtained. Namely, even in the case where a constituent material of toner particles contains components which are difficult to be dispersed in a binder resin or difficult to be mutually soluble to each other, these components are finely dispersed in an obtained kneaded material and mutually soluble to each other satisfactorily in an obtained kneaded material by way of the kneading step described above. In particular, most of pigments (coloring agent) have relatively poor dispersibility to an insulation liquid which will be described later. However, in this embodiment, because the kneading step has been carried out before the kneaded material is dispersed into the insulation liquid, the outer periphery of each particle of a pigment is coated with a resin component and the like effectively during the kneading step. Therefore, dispersibility of the pigment to the insulation liquid is improved (particularly, the pigment can be finely dispersed in the insulation liquid), so that color development of a finally obtained liquid developer becomes excellent. For these reasons, even in the case where a constituent material of toner particles contains a component having poor dispersibility to an insulation liquid (hereinafter, this component will be referred to as "poor dispersibility component"), it is possible to make dispersibility of a dispersoid (that is, the molten state kneaded material) in a molten state kneaded material dispersed liquid particularly excellent. With this result, in a finally obtained liquid developer, variations in compositions and properties of respective toner particles can be made small, and therefore the liquid developer can have excellent properties as a whole.

On the other hand, in the case where a material which has not been kneaded is used in preparing a molten state kneaded material dispersed liquid, a poor dispersibility component and the like are aggregated and then the aggregates thereof settle down in the molten state kneaded material dispersed liquid. As a result, a dispersoid comprised of relatively large particles which are mainly constituted from the poor dispersibility component and which have not been sufficiently mixed with other components exists in the molten state kneaded material dispersed liquid. That is, a dispersoid comprised of large particles which are mainly constituted from the poor dispersibility component and a dispersoid comprised of particles constituted from components other than the poor dispersibility component exist in the molten state kneaded material dispersed liquid in a mixed state. Accordingly, toner particles obtained in a molten state kneaded material dispersed liquid cooling step described later are apt to have large variations in compositions, size and shape of the respective toner particles. As a result, properties of a liquid developer obtained are lowered as a whole.

Further, in the molten state kneaded material dispersed liquid used in the present invention, a dispersoid is in a molten sate (that is, a dispersoid has fluidity so that it can be deformed relatively easily), there is a tendency that each dispersoid is formed into a shape having a relatively high roundness (sphericity) due to its surface tension. Accordingly, in a liquid developer prepared using the molten state kneaded material dispersed liquid, there is also a tendency that toner particles having relatively high roundness (sphericity) are dispersed therein. Further, in the molten state kneaded material dispersed liquid containing a dispersoid in a molten state (that is, a dispersoid having fluidity so that it can be deformed relatively easily), it is possible to raise uniformity in the size of the dispersoid relatively easily by stirring the molten state kneaded material dispersed liquid.

<Molten State Kneaded Material Dispersed Liquid Preparing Step>

Next, by using the kneaded material described above, a molten state kneaded material dispersed liquid comprised of an insulation liquid and a dispersoid (a molten state kneaded material) for constituting toner particles dispersed in the insulation liquid is prepared (molten state kneaded material dispersed liquid preparing step).

Although a method of preparing a molten state kneaded material dispersed liquid is not limited to any specific one, a molten state kneaded material dispersed liquid is prepared in the following manner in the present embodiment. Namely, the above mentioned ground kneaded material is added to an insulation liquid which has been in advance heated to a predetermined temperature so that the ground kneaded material becomes a molten state to thereby prepare a molten state kneaded material dispersed liquid.

The insulation liquid used in the present invention contains as its major component an unsaturated fatty acid. By using such an insulation liquid containing as its major component the unsaturated fatty acid and subjecting a toner material (that is, kneaded material) to melting treatment in the insulation liquid so that the toner material becomes a molten state in the insulation liquid, compatibility of the toner material with the insulation liquid can be improved.

However, such a melting treatment has not been carried out in a prior art liquid developer producing method. In addition, the effect that compatibility of toner particles with an insulation liquid can be improved by such a melting treatment is a unique advantage only in the case where an insulation liquid which contains as its major component an unsaturated fatty is used. Namely, such an effect cannot be obtained in an insulation liquid used in the prior art.

Further, since an unsaturated fatty acid is a substance which is harmless to environment, it is possible to produce a liquid developer which is also harmless to environment. In particular, an adverse effect on environment which may be caused by, for example, volatilization of an insulation liquid during the use of the liquid developer for a fixation process, disposal of a liquid developer, and the like can be prevented or reduced.

Examples of the unsaturated fatty acid include monounsaturated fatty acid such as oleic acid and palmitoleic acid, polyunsaturated fatty acid such as linoleic acid, α-linolenic acid, γ-linolenic acid, arachidonic acid, docosahexaenoic acid (DHA) and eicosapentaenoic acid (EPA) and the like. These unsaturated fatty acid can be used singly or in combination of two or more of them.

Further, such unsaturated fatty acids can be obtained effectively from naturally derived oils such as vegetable oil, animal oil and the like. Examples of vegetable oil include soybean oil, rape oil, linseed oil, safflower oil, cottonseed oil, olive oil while examples of animal oil include herring oil, sardine oil, and the like.

In this regard, it is to be noted that in this specification the term "an insulation liquid which contains as its major component an unsaturated fatty acid" indicates an insulation liquid in which the amount of unsaturated fatty acid contained therein is 50 wt % or more, and preferably 70 wt % or more.

An electric resistance of the above described insulation liquid at room temperature (20° C.) is preferably $10^9$ Ωcm or more, more preferably $10^{11}$ Ωcm or more, and even more preferably $10^{13}$ Ωcm or more. Further, dielectric constant of the insulation liquid is preferably 3.5 or less.

In addition, the insulation liquid may contain an antioxidant. This makes it possible to prevent the insulation liquid from deteriorating due to oxidization while being heated.

Examples of the antioxidant include tocopherol (vitamin E), dibutylated hydroxytoluene (BHT), L-ascorbic acid (vitamin C), ascorbate stearate ester, sodium erythorbate, butylhydroxyanisole, green tea extract (catechin), green coffee extract (a main component thereof is chlorogenic acid) and the like.

Among these antioxidants, vitamin E is preferably used. Since vitamin E is a naturally derived component and a material produced by oxidization of vitamin E has less effect on a liquid developer, it is possible to obtain a liquid developer which is more harmless to environment.

The amount of the antioxidant contained in the insulation liquid is preferably in the range of 0.01 to 10 wt %, and more preferably in the range of 0.1 to 5 wt %.

The heating temperature of the insulation liquid is not limited to any specific value as long as the ground kneaded material added thereto can be molten. However, it is preferred that when the heating temperature of the insulation is defined as Th (° C.), a softening point of the resin material contained in the ground kneaded material is defined as $T_f$ (° C.), and a boiling point of the insulation liquid is defined as Tb (° C.), a relation of $T_f \leqq Th \leqq Tb$ is satisfied, and, more preferably the relation of $T_f+5 \leqq Th \leqq Tb-10$ is satisfied. This makes it possible to obtain the molten state kneaded material dispersed liquid in which a dispersoid (molten state kneaded material) having more uniform shape and size is dispersed while preventing deterioration of the insulation liquid. Further, in the case where the insulation liquid contains an antioxidant, it becomes possible to also prevent deterioration of the antioxidant as well as the insulation liquid.

The molten state kneaded material dispersed liquid obtained in this way is then stirred for a predetermined time for finely dispersing the molten state kneaded material.

Further, in the present invention, it is preferred that the molten state kneaded material dispersed liquid is prepared in a non-oxygenated atmosphere. This makes it possible to prevent the insulation liquid from deteriorating due to oxidization more reliably. Examples of a non-oxygenated atmosphere include an inert gas atmosphere such as a nitrogen gas atmosphere and an argon gas atmosphere, a vacuum atmosphere and the like.

Further, in preparing the molten state kneaded material dispersed liquid, a surfactant or the like may be used for the purpose of improving the dispersibility of the dispersoid (molten state kneaded material). Examples of such a surfactant include: inorganic dispersants such as viscosity mineral, silica, tricalcium phosphate, and the like; nonionic organic dispersants such as polyvinyl alcohol, carboxymethyl cellulose, polyethylene glycol, and the like; anionic organic dispersants such as tristearic acid metal salts (e.g., aluminum salts), distearic acid metal salts (e.g., aluminum salts and barium salts), stearic acid metal salts (e.g., calcium salts, lead salts, and zinc salts), linolenic acid metal salts (e.g., cobalt salts, manganese salts, lead salts, and zinc salts), octanoic acid metal salts (e.g., aluminum salts, calcium salts, and cobalt salts), oleic acid metal salts (e.g., calcium salts and cobalt salts), palmitic acid metal salts (e.g., zinc salts), dodecylbenzenesulfonic acid metal salts (e.g., sodium salts), naphthenic acid metal salts (e.g., calcium salts, cobalt salts, manganese salts, lead salts, and zinc salts), resin acid metal salts (e.g., calcium salts, cobalt salts, manganese salts, lead salts, and zinc salts), polyacrylic acid metal salts (e.g., sodium salts), polymethacrylic acid metal salts (e.g., sodium salts), polymaleic acid metal salts (e.g. sodium salts), metal salts of acrylic acid-maleic acid copolymers (e.g., sodium salts), polystyrenesulfonic acid metal salts (e.g. sodium salts); and cationic organic dispersants such as quaternary ammonium salts; and the like. By using the dispersant as described above in preparing the molten state kneaded material dispersed liquid, it is possible to improve the dispersibility of the dispersant. Further, it is also possible to make variations in shape and size of the dispersoid in the molten state kneaded material dispersed liquid particularly small relatively easily, and also possible to make the shape of each dispersoid roughly spherical shape. With these results, it is possible to obtain a liquid developer which is comprised of toner particles each formed into a roughly spherical shape and having uniform shape and size.

The amount of the dispersoid (molten state kneaded material) in the molten state kneaded material dispersed liquid is not particularly limited, but preferably in the range of 1 to 30 wt %, and more preferably 5 to 20 wt %.

The average diameter of the dispersoid in the molten state kneaded material dispersed liquid is not particularly limited, but preferably in the range of 0.01 to 5 μm, and more preferably in the range of 0.1 to 3 μm. This makes it possible to prevent bonding or aggregation of particles of the dispersoid in the molten state kneaded material dispersed liquid more reliably, thereby enabling to make the size of the toner particles finally obtained optimum. In this regard, it is to be noted that the term "average diameter" means an average diameter of dispersed particles of the dispersoid (molten state kneaded material) having the same volume.

Further, the molten state kneaded material dispersed liquid may contain additional components other than the above-mentioned components. Examples of such additional components include a charge controlling agent, a magnetic powder and the like.

Example of the charge controlling agent include metal salts of benzoic acid, metal salts of salicylic acid, metal salts of alkyl salicylic acid, metal salts of catechol, metal-containing bisazo dyes, nigrosine dyes, tetraphenylborate derivatives, quaternary ammonium salts, alkyl pyridinium salts, chlorinated polyesters, nitrohumic acid, and the like.

Examples of the magnetic powder includes a powder of metal oxide such as magnetite, maghemite, various ferrites, cupric oxide, nickel oxide, zinc oxide, zirconium oxide, titanium oxide, magnesium oxide, or the like, and a powder of magnetic material containing a magnetic metals such as Fe, Co, Ni or the like.

The molten state kneaded material dispersed liquid may further contain, for example, zinc stearate, zinc oxide, or cerium oxide, in addition to the above-mentioned materials.

<Molten State Kneaded Material Dispersed Liquid Cooling Step>

Next, the thus obtained molten state kneaded material dispersed liquid is cooled to obtain a liquid developer of the present invention (this step is called as a molten state kneaded material dispersed liquid cooling step).

By cooling the molten state kneaded material dispersed liquid, a dispersoid in a molten state (molten state kneaded material) contained therein is solidified to obtain toner particles.

The cooling rate of the molten state kneaded material dispersed liquid is preferably 100° C./sec or lower, and more preferably in the range of 0.1 to 50° C./sec. By setting the cooling rate to a value within the above range, it becomes possible to obtain a liquid developer in which toner particles having uniform shape and size are dispersed more effectively while preventing aggregation of the molten state kneaded material in the molten state kneaded material dispersed liquid.

Further, an insulation liquid may further be added to the molten state kneaded material dispersed liquid as needed after the cooling step. Namely, a liquid developer may be obtained in the following manner. The molten state kneaded material dispersed liquid is prepared using an enough amount of insulation liquid for dispersing the molten state kneaded material. The molten state kneaded material dispersed liquid is then cooled, after which an insulation liquid is further added thereto to obtain a liquid developer. By producing a liquid developer in such a manner, deterioration of a liquid developer caused by application of heat can be reduced, whereby enabling to further improve storage stability of the liquid developer.

<Liquid Developer>

The liquid developer obtained as described above has small variations in shape and size of the toner particles. Therefore, in such a liquid developer, toner particles are easy to migrate in the insulation liquid (that is, in the liquid developer), and thus it is advantageous in high speed development. Further, since the toner particles have small variations in their shape and size and the insulation liquid containing the unsaturated fatty acid is used, the toner particles therefore have superior dispersibility, so that settle down and floating of the toner particles in the liquid developer are prevented effectively. Therefore, such a liquid developer can keep superior stability for a long period of time.

The average particle size (diameter) of the toner particles in the liquid developer obtained as described above is preferably in the range of 0.1 to 5 μm, more preferably in the range of 0.4 to 4 μm, even more preferably in the range of 0.5 to 3 μm. If the average particle size of the toner particles is within the above range, variations in properties of the toner particles such as chargeable characteristics or fixing properties can be made sufficiently small. Consequently, it is possible to make resolution of a toner image formed from the liquid developer (liquid toner) sufficiently high so that the liquid developer can have high reliability as a whole.

Further, it is preferred that a standard deviation of particle size among the toner particles which constitute the liquid developer is 3.0 μm or less, more preferably in the range of 0.1 to 2.0 μm, and even more preferably in the range of 0.1 to 1.0 μm. When the standard deviation of particle size lies within the above range, variations in electrification properties, fixing properties, and the like are especially small, thereby further improving the reliability of the liquid developer as a whole.

Furthermore, it is also preferred that an average roundness R represented by the following formula (I) is 0.85 or higher, more preferably in the range of 0.90 to 0.99, and even more preferably 0.95 to 0.99.

$$R=L_0/L_1 \quad \text{(I)}$$

wherein $L_1$ (μm) represents the circumference of projected image of a toner particle that is a subject of measurement, and $L_0$ (μm) represents the circumference of a perfect circle (a geometrically perfect circle) having the same area as that of the projected image of the toner particle that is a subject of measurement.

When the average roundness R of the toner particles is within the above range, the transfer efficiency and the mechanical strength of the toner particles can be made excellent while the particle size of the toner particles are made sufficiently small.

In this case, it is preferred that a standard deviation of the average roundness among the toner particles is 0.15 or less, more preferably in the range of 0.001 to 0.10, even more preferably 0.001 to 0.05. When the standard deviation of average roundness among the toner particles lies within the above range, variations in electrification properties, fixing properties, etc are especially small, thereby further improving the reliability of the liquid developer as a whole.

Next, a description will be made with regard to preferred embodiments of an image forming apparatus in which a liquid developer of the present invention can be used.

Figure 2:
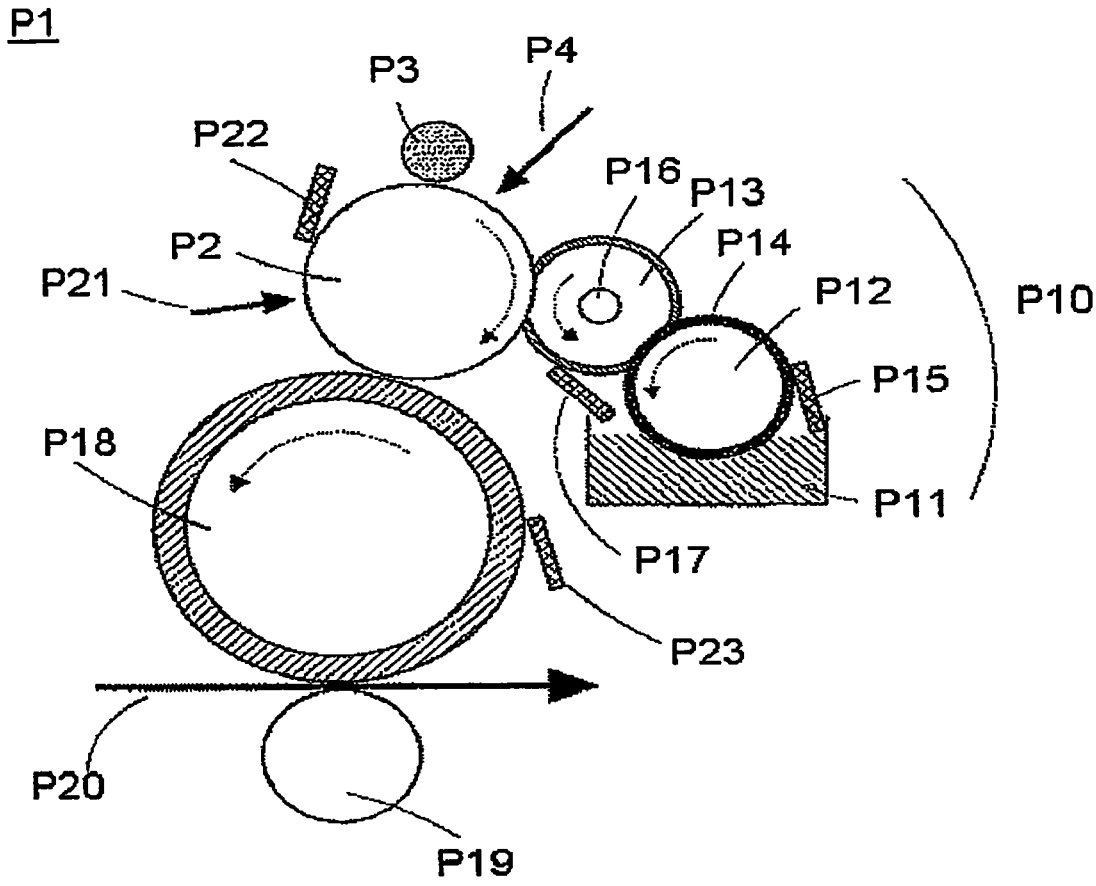
FIG. 2 is a cross-sectional view of one example of a contact type image forming apparatus in which the liquid developer of the present invention can be used.

FIG. 2 is an illustration which shows one example of a contact type image forming apparatus in which the liquid developer of the present invention can be used. The image forming apparatus P1 includes a photoreceptor P2 in the form of a cylindrical drum. After the surface of the photoreceptor P2 is uniformly charged with a charging device P3 made of an epichlorohydrin rubber or the like, exposure P4 corresponding to the information to be recorded is carried out using a laser diode or the like so that an electrostatic latent image is formed.

A developer P10 has an application roller P12 a part of which is immersed in a developer container P11 and a development roller P13. The application roller P12 is formed from, for example, a gravure roller made of stainless steel or the like, which rotates with opposing to the development roller P13. On the surface of the application roller P12, a liquid developer application layer P14 is formed, and the thickness of the layer is adapted to be kept constant by a metering blade P15.

Further, a liquid developer is transferred from the application roller P12 to the development roller P13. The development roller P13 is constructed from a metallic roller core member P16 made from stainless steel or the like, a low hardness silicone rubber layer provided on the metallic core member P16, and a resin layer made of a conductive PFA (polytetrafluoroetylene-perfluorovinylether copolymer) formed on the silicone rubber layer. The development roller P13 is adapted to rotate at the same speed as the photoreceptor P2 to transfer the liquid developer to a latent image section. A part of the liquid developer remaining on the development roller P13 after it has been transferred to the photoreceptor P2 is removed by a development roller cleaning blade P17 and then collected in the developer container P11.

Further, after a toner image is transferred from the photoreceptor to an intermediate transfer roller P18, the photoreceptor is discharged with discharging light P21, and a toner which has not been transferred and remains on the photoreceptor P2 is removed by a cleaning blade P22 made of a urethane rubber or the like.

In a similar manner, a toner which is not transferred and remains on the intermediate transfer roller P18 after the toner image has been transferred to an information recording medium P20 is removed by a cleaning blade P23 made of a urethane rubber or the like.

The toner image formed on the photoreceptor P2 is transferred to the intermediate transfer roller P18. Then, a transfer current is supplied to a secondary transfer roller P19, and the toner image transferred on the intermediate roller P18 is transferred onto the recording medium P20 such as a paper which passes between the intermediate transfer rollers P18 and the secondary transfer roller P19. Thereafter, the toner image on the recording medium P20 is fixed thereto using a fixing unit shown in FIG. 4.

Figure 3:
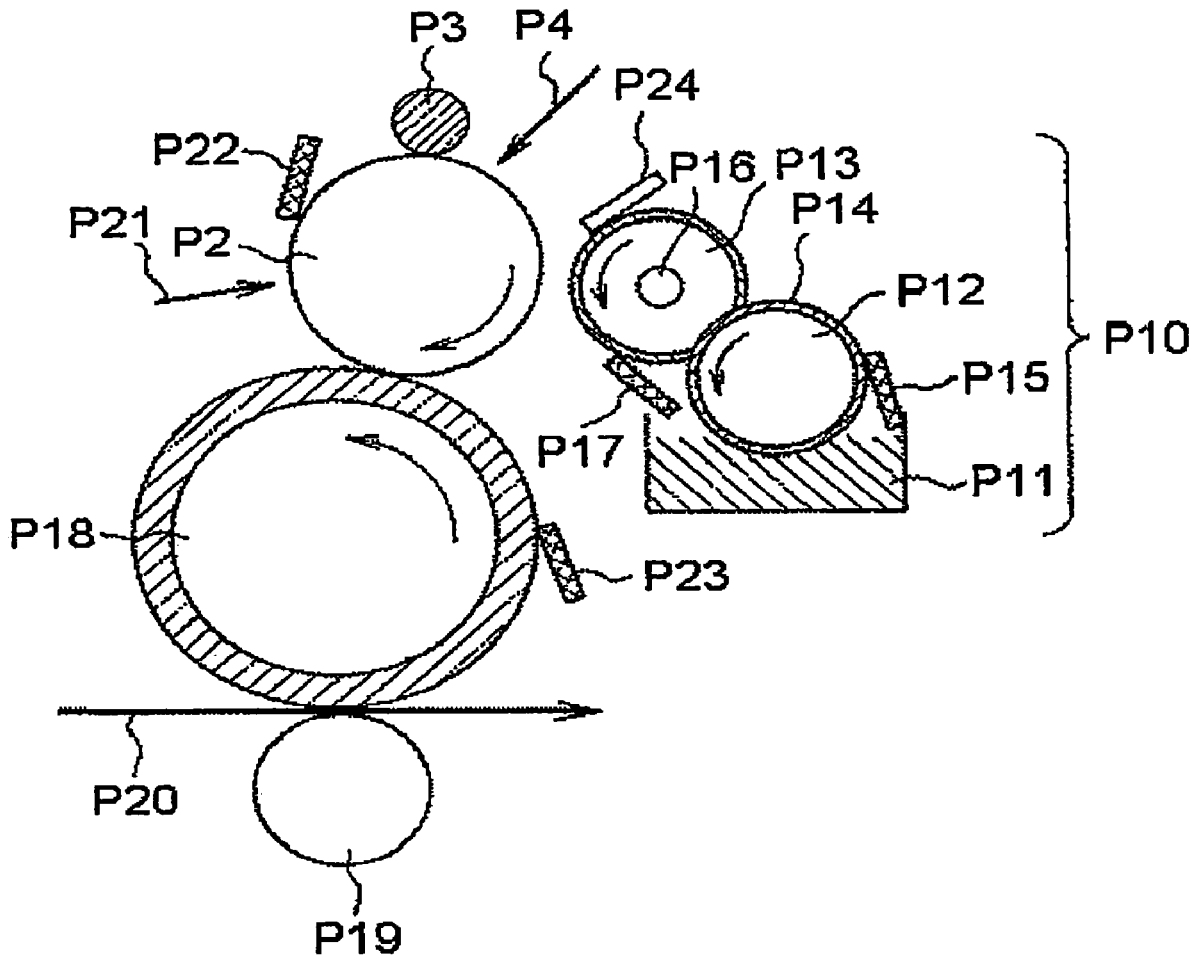
FIG. 3 is a cross sectional view of one example of a non-contact type image forming apparatus in which the liquid developer of the present invention can be used.

FIG. 3 shows one example of a non-contact type image forming apparatus in which the liquid developer according to the present invention can be used. In such a non-contact type image forming apparatus, a development roller P13 is provided with a charging blade P24 which is formed from a phosphor-bronze plate having a thickness of 0.5 mm. The charging blade P24 has a function of causing a layer of the liquid developer to be charged by contacting it. Further, since an application roller P12 is a gravure roller, a layer of a developer having irregularities which correspond to irregularities on the surface of the gravure roller is formed on the development roller P13. The charging blade P24 also has a function of uniforming the irregularities formed on the development roller P13. The orientation of the charging blade P24 is either of a counter direction or a trail direction with respect to the rotational direction of the development roller. Further, the charging blade 24 may be in the form of a roller not a blade.

Preferably, between the development roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the development roller P13 and the photoreceptor P2. Other structures of this non-contact type image forming apparatus are the same as those of the contact type image forming apparatus shown in FIG. 2.

In the foregoing, the description was made with regard to the image formation by the embodiments shown in FIGS. 2 and 3 in which a liquid developer of one color is used. However, it goes without saying that when an image is formed using color toners of a plurality of colors, a color image can be formed by using a plurality of development apparatuses corresponding to the respective colors to form images of the respective colors.

Figure 4:
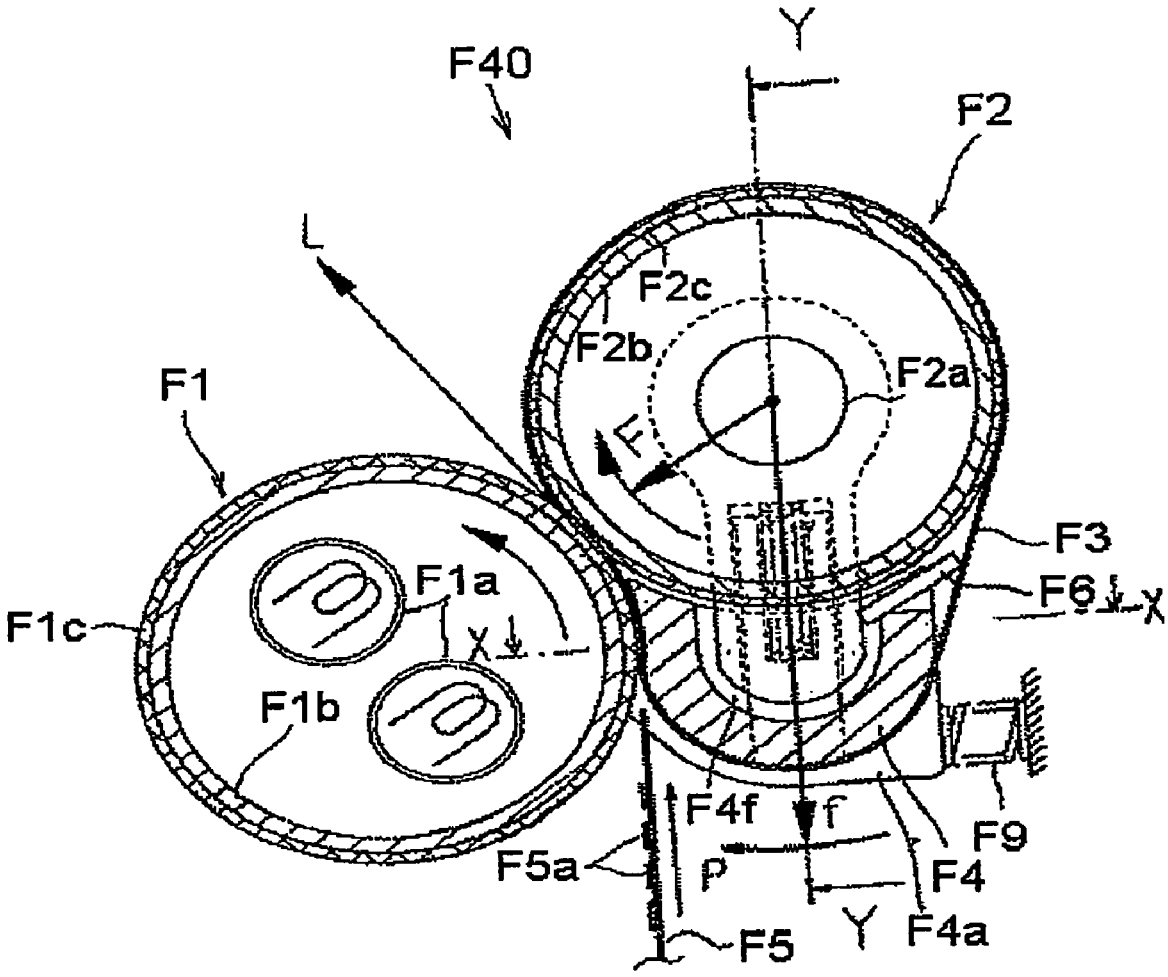
FIG. 4 is a cross-sectional view which shows one example of a fixing apparatus in which the liquid developer of the present invention can be used.

FIG. 4 is a cross-sectional view of a fixing unit, in which F1 denotes a heat fixing roller, F1*a* denotes tubular halogen lamps. F1*b* is a roller base, F1*c* is an elastic body, F2 is a pressure roller, F2*a* is a rotation shaft, F2*b* is a roller base, F2*c* is an elastic body, F3 is a heat resistant belt, F4 is a belt tension member, F4*a* is a protruding wall, F5 is a sheet material, F5*a* is an unfixed toner image, F6 is a cleaning member, F7 is a frame, F9 is a spring, and L is a tangential line of a pressing part.

As shown in this figure, the fixing unit F40 includes the heat fixing roller (hereinafter, also referred to as "heat fuser roller") F1, the pressure roller F2, the heat resistant belt F3, the belt tension member F4, and the cleaning member F6.

The heat fixing roller F1 has the roller base F1*b* formed from a pipe member having an outer diameter of about 25 mm and a thickness of about 0.7 mm. The roller base F1*b* is coated with the elastic body F1*c* having a thickness of about 0.4 mm. Further, inside the roller base F1*b*, two halogen lamps F1*a* which act as a heat source are provided. Each of the halogen lamps F1*a* has a tubular shape and an output of 1,050 W. The heat fixing roller F1 is rotatable in an anticlockwise direction shown by the arrow in FIG. 6. Further, the pressure roller F2 has the roller base F2*b* formed from a pipe member having an outer diameter of about 25 mm and a thickness of about 0.7 mm. The roller base F2*b* is coated with the elastic body F2*c* having a thickness of about 0.2 mm. The pressure roller F2 having the above structures is rotatable in a clockwise direction indicated by the arrow F in FIG. 6, and it is arranged so as to face the heat fixing roller F1 so that a pressing pressure between the heat fixing roller F1 and the pressure roller F2 becomes 10 kg or less and a nip length therebetween is about 10 mm.

As described above, each of the heat fixing roller F1 and the pressure roller F2 is formed to have a small outer diameter of about 25 mm, there is less possibility that a sheet material F5 after the fixing process is wound around the heat fixing roller F1 or the heat resistant belt F3, and thus it is not necessary to have any means for peeling off the sheet material F5 forcibly. Further, since the PFA layer having a thickness of about 30 μm is provided on the surface of the elastic member F1*c* of the heat fixing roller F1, the strength thereof is improved. By providing such a PFA layer, both the elastic members F1*c* and F2*c* are elastically deformed substantially uniformly though their thicknesses are different from each other, thereby forming a so-called horizontal nip. Further, there is no difference between the circumferential velocity of the heat fixing roller F1 and the conveying speed of the heat resistant belt F3 or the sheet material F5. For these reasons, it is possible to perform an extremely stable image fixation.

Further, as described above, the two tubular halogen lamps F1*a*. F1*a* which act as a heat source are provided inside the heat fixing roller F1. These halogen lamps F1*a*, F1*a* are provided with heating elements, respectively, which are arranged at different positions. With this arrangement, by selectively lighting up any one or both of the halogen lamps F1*a*, F1*a*, it is possible to carry out a temperature control easily under different conditions such as a case where a wide sheet material is used or a narrow sheet material is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The heat resistant belt F3 is a ring-shaped endless belt, and it is would around the outer circumferences of the pressure roller F2 and the belt tension member F4 so that it can be moved with being held between the heat fixing roller F1 and the pressure roller F2 in a pressed state. The heat resistant belt F3 is formed from a seamless tube having a thickness of 0.03 mm or more. Further, the seamless tube has a two layered structure in which its surface (which is the surface thereof that makes contact with the sheet material F5) is formed of PFA, and the opposite surface thereof (that is, the surface thereof that makes contact with the pressure roller F2 and the belt tension member F4) is formed of polyimide. However, the structure of the heat resistant belt F3 is not limited to the structure described above, it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the sheet material F5 conveying direction. Further, the belt tension member F4 is pivotally disposed about the rotation shaft F2*a* of the pressure roller F2 so as to be movable along the arrow P. The belt tension member F4 is constructed so that the heat resistant belt F3 is extended with tension in the tangential direction of the heat fixing roller F1 in a state that the sheet material F5 does not pass through the fixing nip part. When the fixing pressure is large at an initial position where the sheet material F5 enters the fixing nip part, there is a case that the sheet material F5 can not enter the fixing nip part smoothly and thereby fixation is performed in a state that a tip part of the sheet material F5 is folded. However, in this embodiment, the belt tension member F4 is provided so that the heat resistant belt F3 is extended with tension in the tangential direction of the heat fixing roller F1 as described above, there is formed an introducing portion for smoothly introducing the sheet material F5, so that the sheet material F5 can be introduced into the fixing nip part in a stable manner.

The belt tension member F4 is a roughly semi-circular member for slidably guiding the heat resistant belt F3 (the heat resistant belt F3 slidably moves on the belt tension member F4). The belt tension member F4 is fitted into the inside of the heat resistant belt F3 so as to impart tension f to the heat resistant belt F3 in cooperation with the pressure roller F2. The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2. The protruding wall F4*a* is formed on any one or both of the end surfaces of the belt tension member F4 which are located in the axial direction thereof. The protruding wall F4 is provided for restricting the heat resistant belt F3 from being off to the side by abutment thereto in a case that the heat resistant belt F3 is deviated in any one of the sides. Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3. However, there is a case that these frictional coefficients become unstable due to enter of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2. With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in a stable manner.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3. By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

A position where the belt tension member F4 is slightly pressed against the heat fixing roller F1 is set as a nip beginning position and a position where the pressure roller F2 is pressed against the heat fixing roller F1 is set as a nip ending position. The sheet material F5 enters the fixing nip part from the nip beginning position to pass through between the heat resistant belt F3 and the heat fixing roller F1, and then fed out from the nip ending position, and during these processes an unfixed toner image F5*a* is fixed on the sheet material F5 and then the sheet material F5 is discharged along the tangential line L of the pressing part between the heat fixing roller F1 and the pressing roller F2.

In the foregoing, the present invention was described based on the preferred embodiments, but the present invention is not limited to these embodiments.

For example, the liquid developer of the present invention is not limited to one that is used in the image forming apparatus as described above.

Further, in the above embodiments, the ground particles are added to the heated insulation liquid. However, the insulation liquid may be heated up after the ground particles are added thereto.

Furthermore, in the above embodiments, a molten state kneaded material dispersed liquid is prepared using the ground particles obtained by grinding the kneaded material, but such a grinding step of the kneaded material may be omitted.

Moreover, in the above embodiments, the ground kneaded material is added to the insulation liquid at first, and the insulation liquid is then heated so that the ground kneaded material becomes a molten state to thereby obtain the molten state kneaded material dispersed liquid. However, the molten state kneaded material dispersed liquid may be obtained by adding the ground kneaded material which has been molten in advance to the insulation liquid.

Moreover, the unsaturated fatty acids used in the present invention may be an unsaturated fatty acid obtained by synthesis.

(1) Production of Liquid Developer

EXAMPLE 1

[Kneaded Material]

First, 80 parts by weight of an epoxy resin (EPICOAT 1004, softening point $T_f$ thereof was 128° C.) as a binder resin, 20 parts by weight of a cyanine pigment ("Pigment Blue 15:3", manufactured by Dainichiseika Color & Chemicals Mfg. Co., Ltd.) as a coloring agent were prepared.

These components were mixed using a 20 L type Henschel mixer to obtain a material for producing toner particles.

Next, the material (mixture) was kneaded using a biaxial kneader-extruder shown in FIG. 1. The entire length of a process section of the biaxial kneader-extruder was 160 cm. Further, the material temperature in the process section was set to be 105 to 115° C. Furthermore, the rotational speed of the screw was 120 rpm, and the speed for feeding the material into the kneader-extruder was 20 kg/hour.

Under these conditions, the time required for the material to pass through the process section was about 4 minutes.

The kneading was carried out with deairing the inside of the process section by driving a vacuum pump connected to the process section through a deairing port.

The material (kneaded material) kneaded in the process section was extruded outside the biaxial kneader-extruder from the head portion. The temperature of the kneaded material at the head portion was adjusted to be 135° C.

The kneaded material extruded from the extruding port of the biaxial kneader-extruder was cooled by a cooling machine as shown in FIG. 1. The temperature of the kneaded material just after the cooling process was about 45° C.

The cooling rate of the kneaded material was 9° C./sec. Further, the time required for the completion of the cooling process from the end of the kneading process was 10 seconds.

The kneaded material that had been cooled as described above was coarsely ground using a hammer mil to be formed into powder (ground material) having an average particle size of 1.0 mm or less.

[Insulation Liquid]

An insulation liquid containing an unsaturated fatty acid was prepared as described below.

Firstly, 130 ml of soybean oil (main unsaturated fatty acid components thereof are as follows; linoleic acid: 54.7%, linolenic acid: 6.4%, and olein acid: 23.6%, and its Tb was 188° C.) was put into a flask. After that, 100 ml of boiled water was poured into the flask, and the flask was then plugged.

Next, the flask was shaken so that the unrefined soybean oil and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was removed and put into a second flask, and the unfrozen component was again subjected to the same operation as described above. Then, an unfrozen component was taken out from the second flask to obtain an insulation liquid.

The thus obtained insulation liquid was mainly composed of linoleic acid and the amount of unsaturated fatty acid contained therein was 85 wt %. Further, the electrical resistance of the insulation liquid at room temperature (20° C.) was $5.2\times10^{13}$ Ωcm and the relative dielectric constant of the insulation liquid was 2.8.

[Preparation of Molten State Kneaded Material Dispersed Liquid]

A mixed solution in which 1 part by weight of dodecyltrimethylammonium chloride as a surfactant, 1 part by weight of octylic acid zirconium as an electrification preventing agent and 360 parts by weight of the insulation liquid (its boiling point was 188° C.) were homogeneously mixed was prepared.

Next, the mixed solution was heated to a temperature of 135° C. in a nitrogen atmosphere and 100 parts by weight of a coarsely ground kneaded material was added thereto. Then, it was stirred with a homomixer (PRIMIX Corporation) for 0.5 hours to thereby obtain a molten state kneaded material dispersed liquid. In this regard, the average particle size of the dispersoid contained in the molten state kneaded material dispersed liquid was 1.4 μm.

Next, the thus obtained molten state kneaded material dispersed liquid was cooled to room temperature with continuously stirring it to thereby obtain a liquid developer. The cooling rate of the molten state kneaded material dispersed liquid was 1.0° C./sec.

EXAMPLE 2

A liquid developer was prepared in the same manner as in Example 1 except that a resin shown in Table 1 was used as a binder resin, the heating temperature of the mixed solution and the cooling rate of the molten state kneaded material dispersed liquid were changed as shown in Table 1 and the insulation liquid was prepared in a manner as described below.

Firstly, 130 ml of rape oil (main unsaturated fatty acid components thereof are as follows; linoleic acid: 23.3%, linolenic acid: 9.9%, and olein acid: 58.0%, and its Tb was 189° C.) was put into a flask. After that, 100 ml of boiled water was poured into the flask, and the flask was then plugged.

Next, the flask was shaken so that the unrefined rape oil and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was removed and put into a second flask, and the unfrozen component was again subjected to the same operation as described above. Then, an unfrozen component was taken out from the second flask to obtain an insulation liquid.

The thus obtained insulation liquid was mainly composed of olein acid and the amount of unsaturated fatty acid contained therein was 93 wt %. Further, the electrical resistance of the insulation liquid at room temperature (20° C.) was $2.2\times10^{13}$ Ωcm and the relative dielectric constant of the insulation liquid was 2.6.

EXAMPLE 3

A liquid developer was prepared in the same manner as in Example 1 except that a resin shown in Table 1 was used as a binder resin, the heating temperature of the mixed solution and the cooling rate of the molten state kneaded material dispersed liquid were changed as shown in Table 1 and the insulation liquid was prepared in a manner as described below.

Firstly, 130 ml of linseed oil (main unsaturated fatty acid components thereof are as follows; linoleic acid: 13.0%, α-linolenic acid: 57.0%, and olein acid: 21.0%, and its Tb was 186° C.) was put into a flask. After that, 100 ml of boiled water was poured into the flask, and the flask was then plugged.

Next, the flask was shaken so that the unrefined linseed oil and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was removed and put into a second flask, and the unfrozen component was again subjected to the same operation as described above. Then, an unfrozen component was taken out from the second flask to obtain an insulation liquid.

The thus obtained insulation liquid was mainly composed of α-linolenic acid and the amount of unsaturated fatty acid contained therein was 91 wt %. Further, the electrical resistance of the insulation liquid at room temperature (20° C.) was $3.6\times10^{13}$ Ωcm and the relative dielectric constant of the insulation liquid was 2.5.

EXAMPLE 4

A liquid developer was prepared in the same manner as in Example 1 except that the nitrogen atmosphere was changed to a vacuum atmosphere (13.3 Pa).

EXAMPLE 5

A liquid developer was prepared in the same manner as in Example 1 except that 3.6 parts by weight of α-tocopherol (vitamin E) as an antioxidant was added to a mixed solution in which 1 part by weight of dodecyltrimethylammonium chloride as a surfactant, 1 part by weight of octylic acid zirconium as an electrification preventing agent and 360 parts by weight of soybean oil as an insulation liquid (its boiling point was 188° C.) were mixed.

EXAMPLE 6

A liquid developer was prepared in the same manner as in Example 1 except that an insulation liquid was prepared in a manner as described below.

Firstly, 130 ml of cottonseed oil (main unsaturated fatty acid components thereof are as follows; linoleic acid: 56.5% and olein acid: 18:4%, and its Tb was 196° C.) was put into a flask. After that, 100 ml of boiled water was poured into the flask, and the flask was then plugged.

Next, the flask was shaken so that the unrefined cottonseed oil and the boiled water were mixed. Then, the flask had been left until a mixed solution therein was separated into three layers. After it was confirmed that the mixed solution was completely separated into three layers, the flask was put in a freezer and left for 24 hours. Subsequently, an unfrozen component in the mixed solution was removed and put into a second flask, and the unfrozen component was again subjected to the same operation as described above. Then, an unfrozen component was taken out from the second flask to obtain an insulation liquid.

The thus obtained insulation liquid was mainly composed of linoleic acid and the amount of unsaturated fatty acid contained therein was 75 wt %. Further, the electrical resistance of the insulation liquid at room temperature (20° C.) was $5.6\times10^{13}$ Ωcm and the relative dielectric constant of the insulation liquid was 2.7.

COMPARATIVE EXAMPLE 1

A liquid developer was prepared in the same manner as in Example 1 except that ISOPAR G (product name of Exson-Mobile Corporation) was used as an insulation liquid.

COMPARATIVE EXAMPLE 2

A liquid developer was prepared in the same manner as in Example 1 except that a mixture of 80 parts by weight of an epoxy resin (its softening point was 128° C.) and 20 parts by weight of a cyanogen-based pigment ("Pigment Blue 15:3", manufactured by Dainichiseika Color & Chemicals Mfg. Co., Ltd.) was used in preparing the molten state kneaded material dispersed liquid instead of the kneaded material

COMPARATIVE EXAMPLE 3

Firstly, in the same manner as Example 1, a coarsely ground kneaded material having an average particle size of 1.0 mm or less was prepared.

Then, 100 parts by weight of the coarsely ground kneaded material was added into a mixture of 360 parts by weight of the insulation liquid, 1 part by weight of dodecyltrimethylammonium chloride as a surfactant and 1 part by weight of octylic acid zirconium which were prepared in Example 1. After that, it was dispersed or ground for 5 hours by a jet mill at room temperature to thereby obtain a dispersion liquid.

Then, 180 parts by weight of the above mentioned insulation liquid was added into the thus obtained dispersion liquid, after which it was mixed or dispersed for 5 hours by a jet mill at room temperature to thereby obtain a liquid developer.

COMPARATIVE EXAMPLE 4

A mixed solution comprised of 100 g of octadecylmethacrylate, 150 g of toluene and 50 g of isopropanol was heated to a temperature of 75° C. with being stirred in a nitrogen gas stream. Then, 30 g of 2,2'-azobis (4-cyanovaleric acid) was added thereto to make reaction for 8 hours, and after being cooled, it was settled out in 2 liter of methanol so that white powder was aggregated and then it was dried. Then, a mixture comprised of 50 g of the thus obtained white powder, 3.3 g of vinyl acetate, 0.2 g of hydroquinone, and 100 g of toluene was heated to a temperature of 40° C. to make reaction for 2 hours. Then, it was heated to 70° C. and $3.8\times10^{-3}$ ml of 100% sulfuric acid was added thereto to make reaction for 10 hours. Thereafter, it was cooled to a temperature of 25° C., and 0.02 g of sodium acetate trihydrate was added thereto. Thereafter, it was stirred for 30 minutes, and then it was settled out in 1 liter of methanol to aggregate, and then it was dried, to thereby obtain a resin for stabilizing dispersion.

Next, a mixed solution comprised of 12 g of the resin for stabilizing dispersion, 100 g of vinyl acetate, 1.0 g of octadecylmethacrylate, 384 g of ISOPAR H was heated to a temperature of 70° C. with being stirred in a nitride gas stream. Then, 0.8 g of 2,2-azobis (isovalernitryl) was added to make reaction for 6 hours. After 20 minutes of addition of an initiator, white turbidity was caused, and then the reaction temperature was raised to 88° C. Thereafter, the temperature was raised to 100° C., and then it was being stirred for 2 hours to distil away the unreacted vinyl acetate. After being cooled, it was passed through a nylon mesh of 200 meshes to thereby obtain white latex particles. The average particle size of the white latex particles was 0.82 μm.

Next, 10 g of a copolymer of dodecylmethaorylate/acrylic acid, 10 g of nigrosine and 30 g of ISOPAR G were put in a paint shaker (manufactured by Tokyo Seiki Co., Ltd.) together with glass beads, and then dispersion was being continued for 4 hours to thereby obtain fine dispersed substances of nigrosine.

Next, 30 g of the white latex particles, 2.5 g of the dispersed substances of nigrosine, and 0.07 g of a copolymer of octadecene/maleate octadecylamide were diluted with 1 liter of ISOPAR G, to thereby obtain a liquid developer.

The conditions for producing the liquid developers of the Examples and the Comparative Examples are shown in the following Table 1.

TABLE 1

| | Resin Material | | Insulation Liquid | | | | | | Heating | |
|---|---|---|---|---|---|---|---|---|---|---|
| | | | Unsaturated Fatty Acid | | | | | Content of | Temperature of Mixed | Cooling |
| | Kind | $T_f$*1 [° C.] | Main Component | Content [wt %] | $T_b$*2 [° C.] | Resistance [Ωcm] | Dielectric Constant | Anti-oxidant [wt %] | Solution [° C.] | Rate [° C./sec] |
| Ex. 1 | Epoxy Resin | 128 | Linoleic Acid | 85 | 188 | $5.2\times10^{13}$ | 2.8 | — | 135 | 1.0 |
| Ex. 2 | Polyester Resin | 124 | Oleic Acid | 93 | 189 | $2.2\times10^{13}$ | 2.6 | — | 130 | 1.0 |
| Ex. 3 | Styrene-Acrylic Copolymer | 125.6 | α-Linolenic Acid | 91 | 186 | $3.6\times10^{13}$ | 2.5 | — | 135 | 1.0 |
| Ex. 4 | Epoxy Resin | 128 | Linoleic Acid | 85 | 188 | $5.2\times10^{13}$ | 2.8 | — | 135 | 1.0 |
| Ex. 5 | Epoxy Resin | 128 | Linoleic Acid | 85 | 188 | $5.2\times10^{13}$ | 2.8 | 1.0 | 135 | 1.0 |
| Ex. 6 | Epoxy Resin | 128 | Linoleic Acid | 75 | 196 | $5.6\times10^{13}$ | 2.7 | — | 135 | 1.0 |
| Com. Ex. 1 | Epoxy Resin | 128 | — | — | 156 | $3.0\times10^{15}$ | 2.0 | — | — | — |
| Com. Ex. 2 | Epoxy Resin | 128 | Linoleic Acid | 85 | 188 | $5.2\times10^{13}$ | 2.8 | — | 135 | 1.0 |

TABLE 1-continued

| | Resin Material | | Insulation Liquid | | | | | | Heating | |
|---|---|---|---|---|---|---|---|---|---|---|
| | | | Unsaturated Fatty Acid | | | | | Content of | Temperature of Mixed | Cooling |
| | Kind | $T_f$*1 [° C.] | Main Component | Content [wt %] | $T_b$*2 [° C.] | Resistance [Ωcm] | Dielectric Constant | Anti-oxidant [wt %] | Solution [° C.] | Rate [° C./sec] |
| Com. Ex. 3 | Epoxy Resin | 128 | Linoleic Acid | 85 | 188 | $5.2 \times 10^{13}$ | 2.8 | — | — | — |
| Com. Ex. 4 | Acrylic Resin | 132 | — | — | 156 | $3.0 \times 10^{16}$ | 2.0 | — | — | — |

*1$T_f$: Softening Point
*2$T_b$: Boiling Point (2) Evaluation

For the respective liquid developers obtained as described above, image density, resolution, and storage stability were evaluated.

(2.1) Image Density

By using the image forming apparatus shown in FIG. 2 and the fixing unit shown in FIG. 4, images having a predetermined pattern were formed on recording papers employing the liquid developers of the Examples and the Comparative Examples, respectively, and then the image density of each recording paper was measured by a colorimeter (X-Rite Incorporated).

(2.2) Resolution

By using the image forming apparatus shown in FIG. 2 and the fixing unit shown in FIG. 4, images having a predetermined pattern were formed on recording papers employing the liquid developers of the Examples and the Comparative Examples, respectively, and then resolution of each image was visually observed.

(2.3) Storage Stability

The liquid developers obtained in the Examples and the Comparative Examples were being placed under the atmosphere in which temperature was in the range of 15 to 25° C. Thereafter, conditions of the toner particles in the liquid developers were visually observed, and the observation results were evaluated by the following four criteria.

A: Suspension of toner particles and aggregation and settling of toner particles were not observed at all.

B: Suspension of toner particles and aggregation and settling of toner particles were scarcely observed.

C: Suspension of toner particles and aggregation and settling of toner particles were slightly observed.

D: Suspension of toner particles and aggregation and settling of toner particles were clearly observed.

These results are shown in the following Table 2 together with the average roundness R, the standard deviation in the roundness, the average particle size, and the standard deviation in the particle size of the toner particles. In this connection, it is to be noted that the roundness R was measured by the use of a flow system particle image analyzer (FPIA-2000, manufactured by Toa Iyodensi Co.). The roundness R was determined by the following formula (I):

$$R=L_0/L_1 \quad \text{(I)}$$

where $L_1$ (μm) represents the circumference of projected image of a particle that is a subject of measurement, and $L_0$ (μm) represents the circumference of a perfect circle having the same area as that of the projected image of the particle that is a subject of measurement.

TABLE 2

| | Average Roundness R | Standard Deviation of Roundness | Average Particle Size [μm] | Standard Deviation of Particle Size [μm] | Evaluation | | |
|---|---|---|---|---|---|---|---|
| | | | | | Image Density | Resolution [?/mm] | Storage Stability |
| Ex. 1 | 0.95 | 0.015 | 1.14 | 0.48 | 1.56 | 7.1 | B |
| Ex. 2 | 0.96 | 0.011 | 1.22 | 0.52 | 1.58 | 8.0 | A |
| Ex. 3 | 0.95 | 0.020 | 1.76 | 0.64 | 1.47 | 6.3 | A |
| Ex. 4 | 0.97 | 0.022 | 1.15 | 0.48 | 1.55 | 7.1 | B |
| Ex. 5 | 0.96 | 0.018 | 1.16 | 0.47 | 1.53 | 7.1 | B |
| Ex. 6 | 0.97 | 0.012 | 1.15 | 0.50 | 1.49 | 6.9 | B |
| Com. Ex. 1 | 0.96 | 0.155 | 1.34 | 1.22 | 1.16 | 5.3 | C |
| Com. Ex. 2 | 0.93 | 0.080 | 1.9 | 1.36 | 1.21 | 5.0 | D |
| Com. Ex. 3 | 0.82 | 0.160 | 2.11 | 1.88 | 0.62 | 5.3 | D |
| Com. Ex. 4 | 0.96 | 0.154 | 0.82 | 1.68 | 1.24 | 5.3 | C |

As shown in Table 2, in the liquid developers of the present invention, the roundness of the toner particles was high and the particle size distribution was small. Further, the toner particles had small variations in shape and size thereof (that is, the standard deviation of the roundness was small).

In contrast, in the liquid developers of the Comparative Examples, the toner particles had large variations in shape and size thereof. Further, in the liquid developers of the Comparative Examples, the toner particles had the unstable shapes, and the roundness thereof was low.

Further, as shown in Table 2, the liquid developers of the present invention had excellent image density, excellent resolution, and excellent storage stability. In contrast, in the liquid developers of the Comparative Examples, satisfactory results could not be obtained.

Furthermore, liquid developers which are the same as those described above were produced excepting that as a coloring agent a pigment red 122, a pigment yellow 180, and a carbon black ("Printex L" Degussa AG) were used instead of a cyanogen-based pigment, and they were evaluated in the same manner as described above. As a result, substantially the same results could be obtained.

Finally, it is to be noted that the present invention is not limited to the embodiments and the examples described above, and many additions and modifications may be made without departing from the spirit of the present invention which are defined by the following claims.

What is claimed is:

1. A method of producing a liquid developer which comprises an insulation liquid and toner particles dispersed in the insulation liquid, the method comprising:

preparing an insulation liquid containing an antioxidant being tocopherol;

preparing a kneaded material containing a coloring agent and a resin material, the kneaded material being in a solid state;

grinding the kneaded material to obtain a ground kneaded material in the form of resin particles;

heating the insulation liquid at a predetermined temperature, and adding the ground kneaded material to the heated insulation liquid so that the ground kneaded material is transformed into a molten state ground kneaded material;

dispersing the molten state ground kneaded material in the heated insulation liquid to obtain a molten state kneaded material dispersed liquid in which the molten state ground kneaded material is finely dispersed in the form of fine particles of the molten state ground kneaded material; and cooling the molten state kneaded material dispersed liquid to solidify the fine particles of the molten state kneaded material so that the fine particles of the molten state kneaded material are transformed into the toner particles;

wherein the insulation liquid contains an unsaturated fatty acid and the amount of the unsaturated fatty acid contained in the insulation liquid is 75 wt % or more, and wherein when the predetermined heating temperature of the insulation liquid is defined as Th (° C.), a softening point of the resin material is defined as $T_f$ (° C.), and a boiling point of the insulation liquid is defined as Tb (° C.), relations of both $T_f+5 \leqq Th \leqq T_f+10$ and $T_f+10 \leqq Tb-10$ are satisfied.

2. The method of producing a liquid developer as claimed in claim 1, wherein the cooling rate of the molten state kneaded material dispersed liquid in the cooling step is 100° C./sec or lower.

3. The method of producing a liquid developer as claimed in claim 1, wherein the molten state kneaded material dispersed liquid is prepared in a non-oxygenated atmosphere.

4. A liquid developer produced using the liquid developer producing method defined in claim l.

5. The liquid developer as claimed in claim 4, wherein an average particle size of the toner particles of the liquid developer is in the range of 0.1 to 5 pm.

6. The liquid developer as claimed in claim 5, wherein the standard deviation in the particle sizes among the toner particles is 3.0 pm or less.

7. The liquid developer as claimed in claim 4, wherein an average value of the roundness R of the toner particles represented by the following formula (I) is 0.85 or more:

$$R=L_0/L_1 \quad (I)$$

wherein $L_1$ (μm) represents the circumference of a projected image of a toner particle, and $L_0$ (μm) represents the circumference of a perfect circle having the same area as that of the projected image of the toner particle.

8. The liquid developer as claimed in claim 7, wherein the standard deviation in the average roundness among the toner particles is 0.15 or less.

9. The method of producing a liquid developer as claimed in claim 1, wherein the softening point of the resin material is in the range of 124 to 130° C.

10. The method of producing a liquid developer as claimed in claim 1, wherein the boiling point of the insulation liquid is in the range of 186 to 196° C.

11. The method of producing a liquid developer as claimed in claim 1, wherein the preparing the kneaded material is carried out by using a kneading machine having an extrusion port, and between preparing the kneaded material and the grinding the kneaded material the method further comprises:

extruding the kneaded material through the extrusion port of the kneading machine; and cooling the extruded kneaded material to thereby solidity the extruded kneaded material.

* * * * *